US005718331A

United States Patent [19]

Smith

[11] Patent Number: 5,718,331

[45] Date of Patent: Feb. 17, 1998

[54] T-SHIRT STORAGE AND DISPLAY APPARATUS

[76] Inventor: Steven Powell Smith, 350 Marina Dr., Apt. 29, Seal Beach, Calif. 90740-6038

[21] Appl. No.: 726,989

[22] Filed: Oct. 7, 1996

[51] Int. Cl.[6] ..... B65D 85/18

[52] U.S. Cl. ..... 206/292; 206/278; 206/468; 206/771; 229/87.17

[58] Field of Search ..... 206/278, 279, 206/281, 292, 464, 468, 771, 777, 778, 781, 575, 578; 229/87.15, 87.17, 162; 220/602

[56] References Cited

U.S. PATENT DOCUMENTS

| | | | |
|---|---|---|---|
| D. 183,095 | 6/1958 | Hesse | 206/278 X |
| 2,778,487 | 1/1957 | Raeburn | 206/776 X |
| 2,893,546 | 7/1959 | Kendall et al. | 206/278 |
| 3,044,605 | 2/1962 | Clement | 206/776 |
| 4,058,215 | 11/1977 | Marchbank | 206/575 X |
| 4,071,139 | 1/1978 | Pernicano et al. | 206/292 X |
| 4,310,091 | 1/1982 | Hara et al. | 206/578 X |
| 5,316,139 | 5/1994 | Judd et al. | 206/292 X |

FOREIGN PATENT DOCUMENTS

| | | | |
|---|---|---|---|
| 228335 | 11/1958 | Australia | 206/468 |
| 38770 | 10/1981 | European Pat. Off. | 206/279 |
| 2581625 | 11/1986 | France | 206/279 |
| 2269366 | 2/1994 | United Kingdom | 206/468 |

*Primary Examiner*—Sue A. Weaver

[57] ABSTRACT

A t-shirt storage and display apparatus includes a clear frame. A cardboard insert is removably received within the clear frame. A t-shirt is positioned between the cardboard insert and the clear frame whereby a logo on the t-shirt can be viewed through the clear frame.

1 Claim, 5 Drawing Sheets

FIG 3
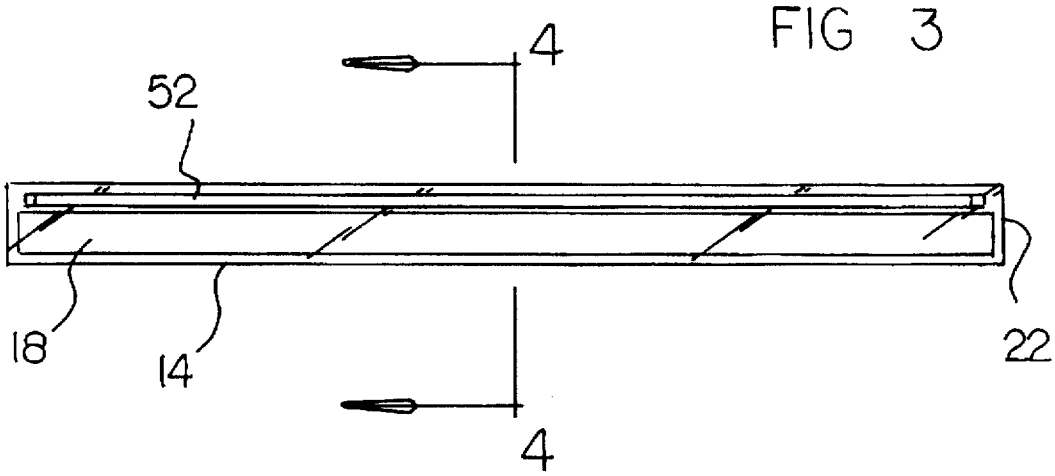
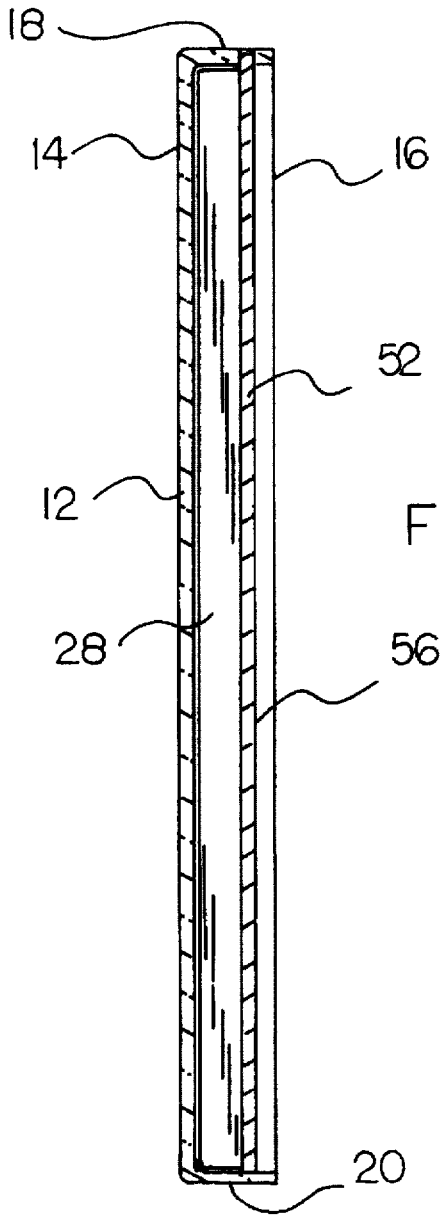
FIG 4

T-SHIRT STORAGE AND DISPLAY APPARATUS

BACKGROUND OF THE INVENTION

1. Field of the Invention

The present invention relates to a t-shirt storage and display apparatus and more particularly pertains to storing a t-shirt for display with a t-shirt storage and display apparatus.

2. Description of the Prior Art

The use of shirt packages is known in the prior art. More specifically, shirt packages heretofore devised and utilized for the purpose of displaying shirts are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,316,139 to Judd et al. discloses a shirt storage and package apparatus.

U.S. Pat. No. 4,778,050 to Baptiste discloses a package for packaging a shirt or the like.

U.S. Pat. No. 5,292,003 to Baghdassarian discloses a combined gift box and display packaging.

U.S. Pat. No. 5,226,532 to Davidson et al. discloses a gift container and greeting card holder.

U.S. Pat. No. 5,193,675 to Otis discloses a baby merchandise display package.

U.S. Pat. No. Des. 331,875 to Serna discloses the ornamental design for a gift box.

While these devices fulfill their respective, particular objective and requirements, the aforementioned patents do not describe a t-shirt storage and display apparatus for storing a t-shirt for display.

In this respect, the t-shirt storage and display apparatus according to the present invention substantially departs from the conventional concepts and designs of the prior art, and in doing so provides an apparatus primarily developed for the purpose of storing a t-shirt for display.

Therefore, it can be appreciated that there exists a continuing need for new and improved t-shirt storage and display apparatus which can be used for storing a t-shirt for display. In this regard, the present invention substantially fulfills this need.

SUMMARY OF THE INVENTION

In the view of the foregoing disadvantages inherent in the known types of shirt packages now present in the prior art, the present invention provides an improved t-shirt storage and display apparatus. As such, the general purpose of the present invention, which will be described subsequently in greater detail, is to provide a new and improved t-shirt storage and display apparatus and method which has all the advantages of the prior art and none of the disadvantages.

To attain this, the present invention essentially comprises a clear frame having a generally rectangular configuration. The clear frame has a closed front face, an open rear face, a top edge, a bottom edge and two side edges. The top edge has an elongated slot formed therethrough. The elongated slot is positioned closer to the open rear face than the closed front face. The device includes a cardboard insert having a generally rectangular configuration. The insert has a front surface, a rear surface, a top edge, a bottom edge and two side edges. The insert is removably received within the open rear face for positioning within the clear frame whereby an exterior end of the top edge positioned inwardly of the elongated slot of the top edge of the clear frame. A t-shirt is positioned between the cardboard insert and the clear frame whereby a logo on the t-shirt can be viewed through the closed front face of the clear frame. The device includes a locking insert having a generally rectangular configuration. The locking insert has a front surface, a rear surface, a top edge, a bottom edge and two side edges. The locking insert is dimensioned for sliding through the elongated slot in the top edge of the clear frame and along the rear surface of the cardboard insert for securement of the cardboard insert within the clear frame.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved t-shirt storage and display apparatus which has all the advantages of the prior art shirt packages and none of the disadvantages.

It is another object of the present invention to provide a new and improved t-shirt storage and display apparatus which may be easily and efficiently manufactured and marketed.

It is a further object of the present invention to provide a new and improved t-shirt storage and display apparatus which is of durable and reliable construction.

An even further object of the present invention is to provide a new and improved t-shirt storage and display apparatus which is susceptible of a low cost of manufacture with regard to both materials and labor, and which accordingly is then susceptible of low prices of sale to the consuming public, thereby making such a t-shirt storage and display apparatus economically available to the buying public.

Still yet another object of the present invention is to provide a new and improved t-shirt storage and display apparatus which provides in the apparatuses and methods of the prior art some of the advantages thereof, while simultaneously overcoming some of the disadvantages normally associated therewith.

Even still another object of the present invention is to provide a new and improved t-shirt storage and display apparatus for storing a t-shirt for display.

Lastly, it is an object of the present invention to provide a new and improved t-shirt storage and display apparatus including a clear frame. A cardboard insert is removably received within the clear frame. A t-shirt is positioned between the cardboard insert and the clear frame whereby a logo on the t-shirt can be viewed through the clear frame.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the preferred embodiment of the present invention.

FIG. 4 is a cross-sectional view as taken along line 4—4 of FIG. 3.

Figure 1:
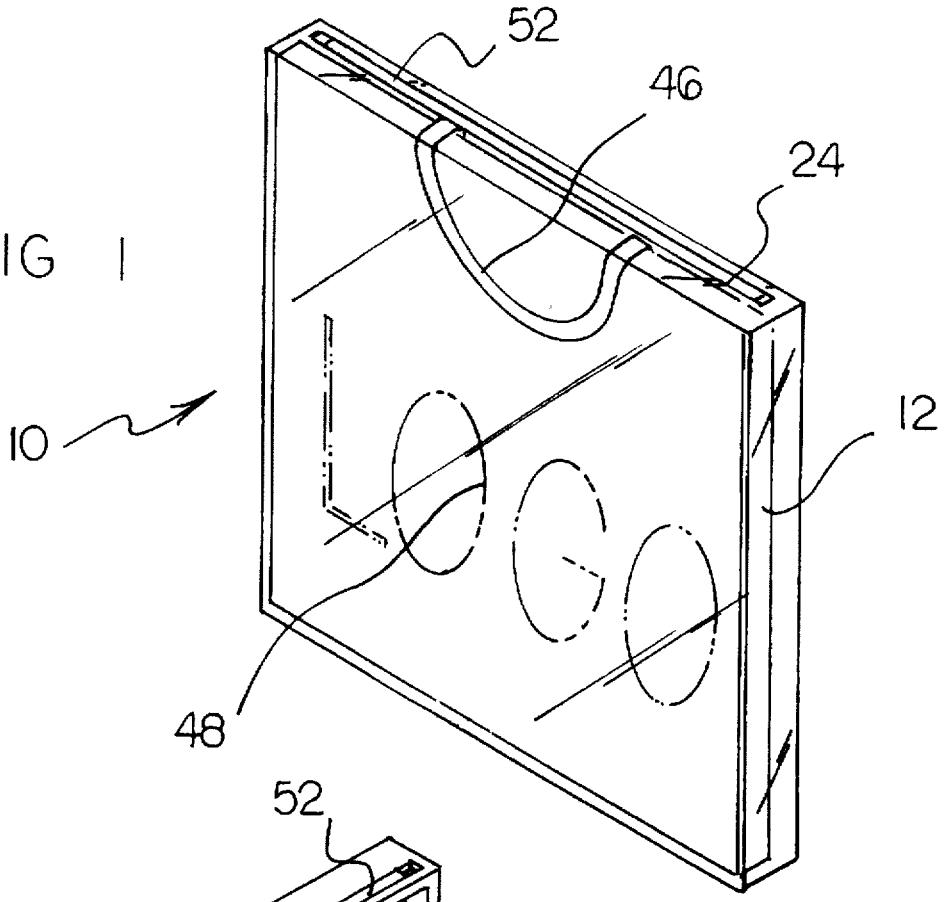
FIG. 1 is a perspective view of the preferred embodiment of the t-shirt storage and display apparatus constructed in accordance with the principles of the present invention.
Figure 2:
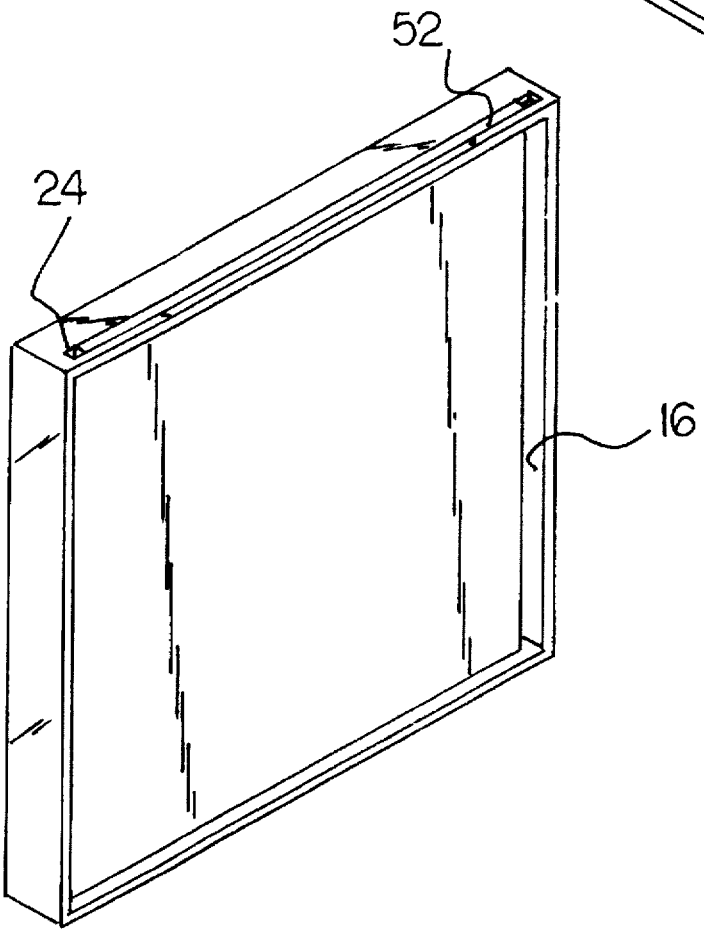
FIG. 2 is a rear perspective view of the present invention.
Figure 5:
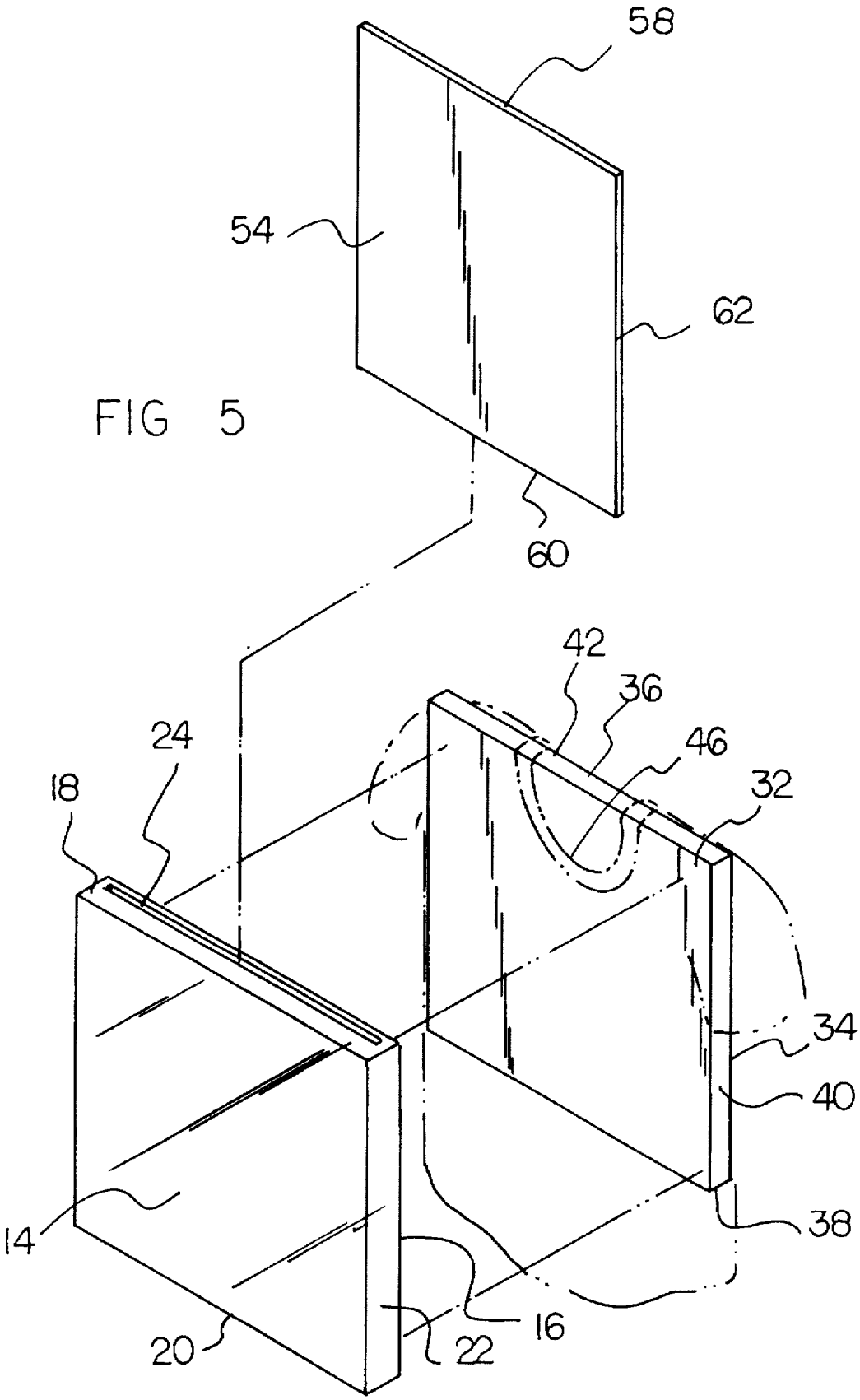
FIG. 5 is an exploded perspective view of the present invention.
Figure 6:
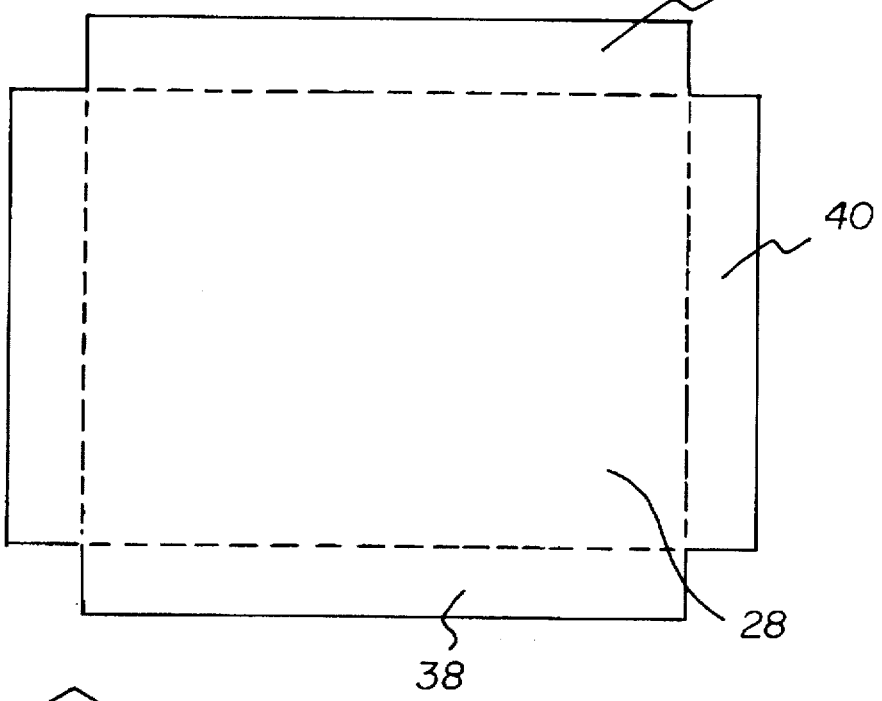
FIG. 6 is a plan view of the cardboard box of the present invention.

The same reference numerals refer to the same parts through the various Figures. cl DESCRIPTION OF THE PREFERRED EMBODIMENT With reference now to the drawings, and in particular, to FIGS. 1–9 thereof, the preferred embodiment of the new and improved t-shirt storage and display apparatus embodying the principles and concepts of the present invention and generally designated by the reference number 10 will be described.

Specifically, it will be noted in the various Figures that the device relates to a t-shirt storage and display apparatus for storing a t-shirt for display. In its broadest context, the device consists of a clear frame, a cardboard insert, a t-shirt and a locking insert. Such components are individually configured and correlated with respect to each other so as to attain the desired objective.

The device 10 includes a clear frame 12 having a generally rectangular configuration. The clear frame 12 has a closed front face 14, an open rear face 16, a top edge 18, a bottom edge 20 and two side edges 22. The top edge 18 has an elongated slot 24 formed therethrough. The elongated slot 24 is positioned closer to the open rear face 16 than the closed front face 14.

The device 10 also includes a cardboard insert 28 having a generally rectangular configuration. The insert 28 has a front surface 32, a rear surface 34, a top edge 36, a bottom edge 38 and two side edges 40. The insert 28 is removably received within the open rear face 16 for positioning within the clear frame 12 whereby an exterior end 42 of the top edge 36 is positioned inwardly of the elongated slot 24 of the top edge 18 of the clear frame 12. The dimensions of the cardboard insert 28 are slightly less than the dimensions of an interior of the clear frame 12. The dimensions of the cardboard insert 28 and the clear frame 12 can be varied to suit numerous applications.

In association with the clear frame 12 and the cardboard insert 28 is A t-shirt 46. The t-shirt 46 is positioned between the cardboard insert 28 and the clear frame 12 whereby a logo 48 on the t-shirt 46 can be viewed through the closed front face 14 of the clear frame 12. The t-shirt 46 is folded over the front surface 32 of the cardboard insert 28 and is then inserted into the clear frame 12 with the logo 48 displayed in the front face 14 of the clear frame 12.

Lastly, the device 10 includes a locking insert 52 having a generally rectangular configuration. The locking insert 52 has a-front surface 54, a rear surface 56, a top edge 58, a bottom edge 60 and two side edges 62. The locking insert 52 is dimensioned for sliding through the elongated slot 24 in the top edge 18 of the clear frame 12 and along the rear surface 34 of the cardboard insert 28 for securement of the cardboard insert 28 within the clear frame 12.

Figure 7:
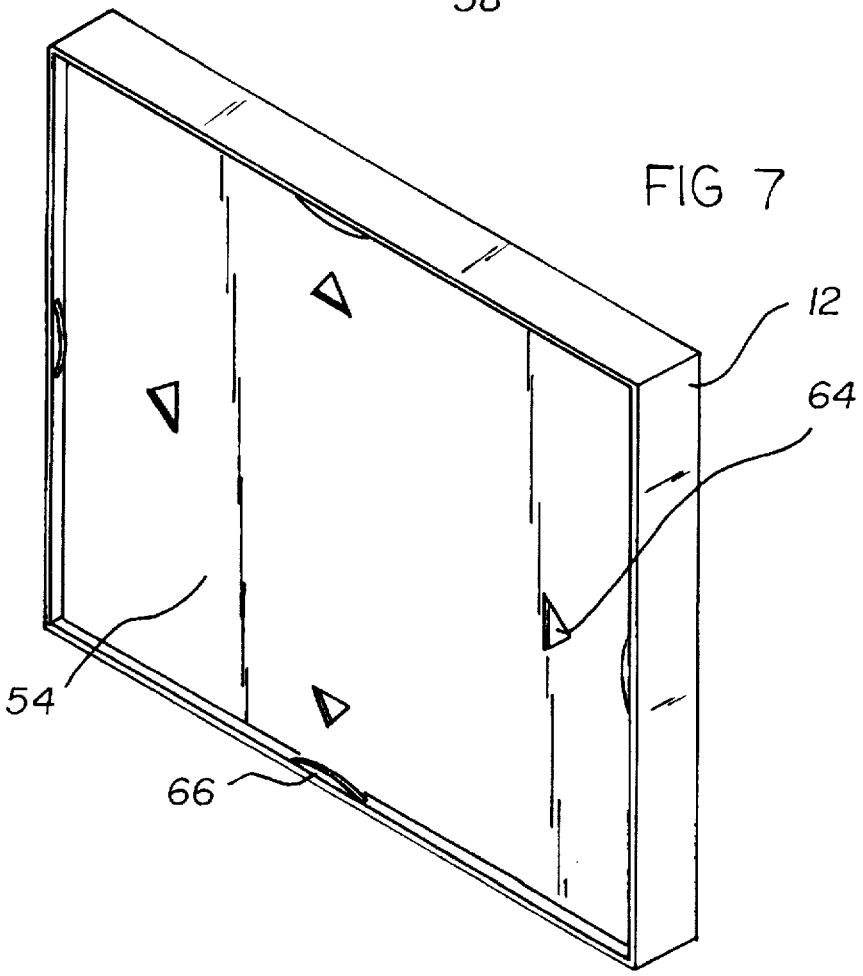
FIG. 7 is a perspective view of a second embodiment of the present invention.
Figure 8:
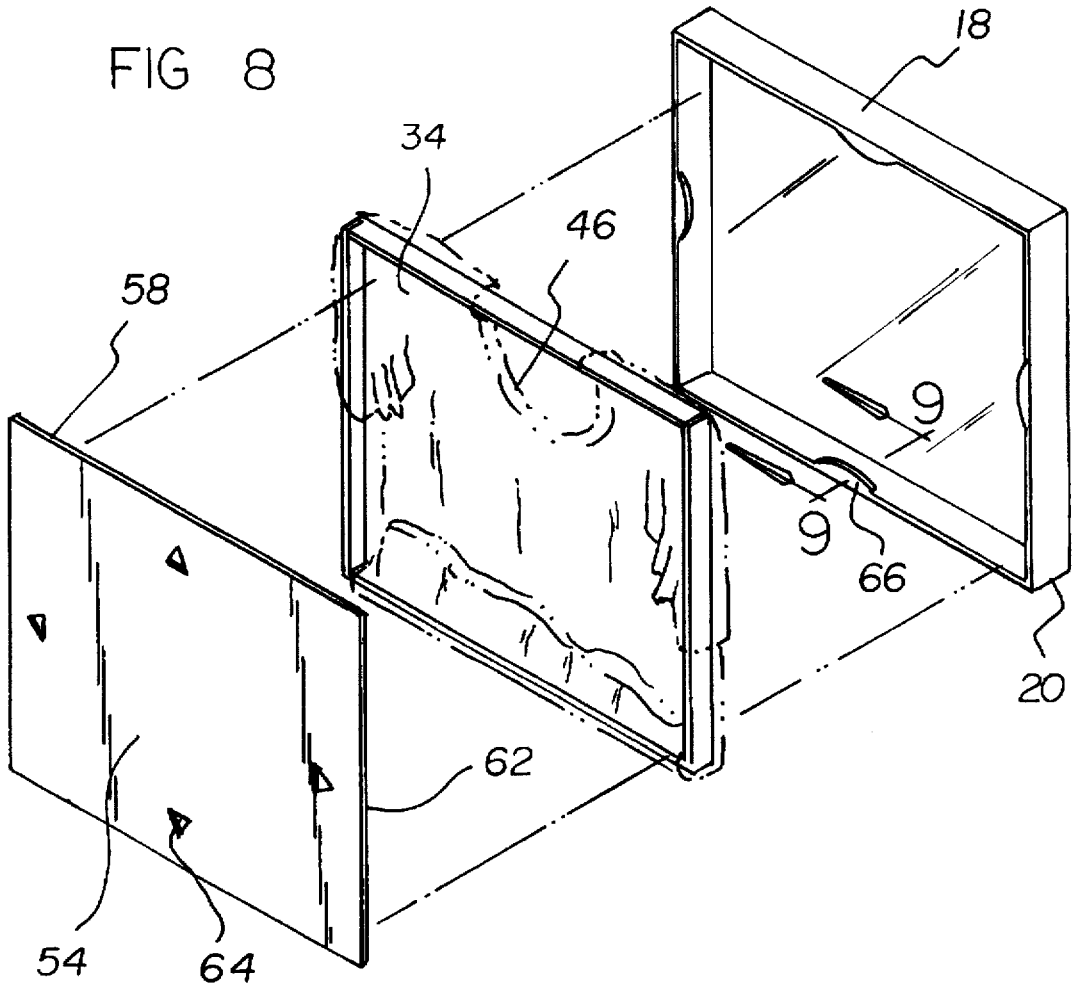
FIG. 8 is an exploded perspective view of the second embodiment of the present invention.
Figure 9:
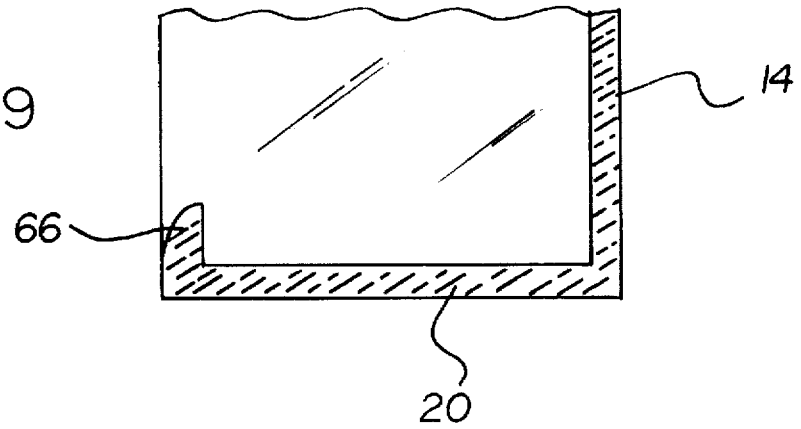
FIG. 9 is a cross-sectional view as taken along line 9—9 of FIG. 8.

A second embodiment of the present invention is illustrated in FIGS. 7 and 8 and include substantially all of the elements of the preferred embodiment wherein the locking insert 54 is positionable along a rear surface 34 of the cardboard insert 28 for securement of the cardboard insert 28 within the clear frame 12. The locking insert 54 has a plurality of holes 64 therethrough for mounting of the device 10 on a recipient surface, such as a wall. Edges of the clear frame 12 have retaining brackets 66 thereon for locking the locking insert 54 within the clear frame 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A t-shirt storage and display apparatus for storing a t-shirt for display comprising, in combination:

a clear frame having a generally rectangular configuration, the clear frame having closed front face, an open rear face, a top edge, a bottom edge and two side edges, the top edge having an elongated slot formed therethrough, the elongated slot positioned closer to the open rear face than the closed front face, the elongated slot positioned inwardly of the open rear face;

a cardboard insert having a generally rectangular configuration, the insert having front surface, a rear surface, a top edge, a bottom edge and two side edges, the top edge, bottom edge and two side edges being foldably secured to the front and rear surfaces, the insert removably received within the open rear face for positioning within the clear frame whereby an exterior end of the top edge positioned inwardly of the elongated slot of the top edge of the clear frame;

a t-shirt positioned between the cardboard insert and the clear frame whereby a logo on the t-shirt can be viewed through the closed front face of the clear frame; and a locking insert having a generally rectangular configuration, the locking insert having a front surface, a rear surface, a top edge, a bottom edge and two side edges, the locking insert dimensioned for sliding through the elongated slot in the top edge of the clear frame and along the rear surface of the cardboard insert for securement of the cardboard insert within the clear frame whereby the locking insert is positioned inwardly of the open rear face of the clear frame.

* * * * *